US006712678B1

(12) United States Patent
Wada et al.

(10) Patent No.: US 6,712,678 B1
(45) Date of Patent: Mar. 30, 2004

(54) POLISHING-PRODUCT DISCHARGING DEVICE AND POLISHING DEVICE

(75) Inventors: Yutaka Wada, Tokyo (JP); Hirokuni Hiyama, Kanagawa (JP); Kazuto Hirokawa, Tokyo (JP); Hisanori Matsuo, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/890,880

(22) PCT Filed: Dec. 7, 1999

(86) PCT No.: PCT/JP99/06849

§ 371 (c)(1),
(2), (4) Date: Sep. 21, 2001

(87) PCT Pub. No.: WO01/43178

PCT Pub. Date: Jun. 14, 2001

(51) Int. Cl.[7] ..... B24B 29/00
(52) U.S. Cl. ..... 451/285; 451/443; 451/444
(58) Field of Search ..... 451/56, 443, 444, 451/60, 285, 286, 287, 288

(56) References Cited

U.S. PATENT DOCUMENTS 5,645,682 A * 7/1997 Skrovan ..... 438/692
5,657,123 A 8/1997 Mogi et al.
5,690,544 A 11/1997 Sakurai
5,709,593 A 1/1998 Guthrie et al.
5,882,251 A * 3/1999 Berman et al. ..... 451/527
5,921,855 A * 7/1999 Osterheld et al. ..... 451/527
5,989,107 A * 11/1999 Shimizu et al. ..... 451/57
6,051,499 A 4/2000 Tolles et al.
6,089,966 A * 7/2000 Arai et al. ..... 451/533
6,106,662 A 8/2000 Bibby, Jr. et al.
6,159,088 A * 12/2000 Nakajima ..... 451/527
6,190,236 B1 * 2/2001 Drill ..... 451/41
6,193,587 B1 * 2/2001 Lin et al. ..... 451/56
6,200,207 B1 * 3/2001 Hsu ..... 451/443
6,227,947 B1 * 5/2001 Hu et al. ..... 451/56

FOREIGN PATENT DOCUMENTS

| | | |
|---|---|---|
| JP | 10-15823 | 1/1998 |
| JP | 10-118915 | 5/1998 |
| JP | 10-118916 | 5/1998 |
| JP | 10-335288 | 12/1998 |
| JP | 10-337651 | 12/1998 |
| JP | 11-285962 | 10/1999 |

* cited by examiner

*Primary Examiner*—Dung Van Nguyen
(74) *Attorney, Agent, or Firm*—Wenderoth, Lind & Ponack L.L.P.

(57) ABSTRACT

It is an object of the present invention to provide a mechanism for effectively discharging debris produced when a substrate is polished by a bonded-abrasive element, and a polishing apparatus. According to the present invention, a polishing apparatus presses a surface of a substrate against a bonded-abrasive surface and moves the surface to be polished and the bonded-abrasive surface relative to each other to polish the surface. A mechanism is provided for discharging debris produced on the bonded-abrasive surface when the surface to be polished is polished.

14 Claims, 13 Drawing Sheets

POLISHING-PRODUCT DISCHARGING DEVICE AND POLISHING DEVICE

TECHNICAL FIELD

The present invention relates to a mechanism for discharging debris produced when a workpiece such as semiconductor wafers, various hard disks, glass substrates, liquid crystal panels, etc. is polished, and a polishing apparatus.

BACKGROUND ART

A conventional CMP (Chemical Mechanical Polishing) apparatus for use in the process of fabricating semiconductor integrated circuit devices comprises a polishing cloth mounted on a turntable and a rotatable top ring for holding a substrate to be polished against the polishing cloth to polish a surface of the substrate (free abrasive polishing) while a polishing slurry is being supplied to the polishing cloth. However, the conventional CMP apparatus is problematic in that it may fail to sufficiently planarize a surface to be polished depending on the type of pattern on the surface or the state of steps (surface irregularities) on the surface.

There has been developed a bonded-abrasive polishing process, which is to be used instead of the CMP apparatus of the above structure. In the process, a substrate to be polished is pressed against a bonded-abrasive and the substrate and the bonded-abrasive are slid relatively to each other while an abrasive liquid (solution) is supplied to the surface of the bonded-abrasive, thereby polishing the substrate.

When the substrate is polished using the bonded-abrasive, however, debris produced by the polishing process, such as waste bits produced by the polishing process, large grain fragments separated from the bonded-abrasive when the bonded-abrasive is dressed, or diamond particles released from the dresser, remains on the surface of the bonded-abrasive, tending to make scratches (flaws) on the surface of the substrate to be polished. Almost no effective means for discharging such debris produced by the bonded-abrasive polishing process has yet been available.

SUMMARY OF THE INVENTION

The present invention has been made in view of the above drawbacks. In particular, it is an object of the present invention to provide a mechanism for effectively discharging debris produced when a substrate is polished by a bonded-abrasive, and a polishing apparatus.

To achieve the above object, there is provided in accordance with the present invention a polishing apparatus for pressing a surface to be polished of a substrate against a bonded-abrasive surface and for moving the surface to be polished and the bonded-abrasive surface relative to each other to polish the surface to be polished. A mechanism is provided for discharging debris produced on the bonded-abrasive surface when the surface to be polished is polished.

With the above arrangement, debris produced when the substrate is polished, large grain fragments separated from the bonded-abrasive surface when the bonded-abrasive surface is dressed, or diamond particles released from a dresser used to dress the bonded-abrasive surface, can effectively be removed from the bonded-abrasive surface and the surface to be polished of the substrate. Thus, scratches (flaws) are effectively prevented from being made on the surface of the substrate being polished.

Preferably, the mechanism for discharging debris may comprise a debris discharging component for discharging the debris. The debris discharging component may comprise grooves defined in the bonded-abrasive surface for discharging the debris therethrough, and a fluid ejecting component for ejecting a liquid or gas in and along the grooves to discharge the debris out through the grooves. In a scroll-type polishing apparatus which incorporates the above mechanism, a liquid such as water, a chemical liquid, or the like can be supplied to a polishing surface provided by the bonded-abrasive surface from below the polishing surface to lubricate and cool the polishing surface and also to discharge the debris effectively out through the grooves. In a table-type polishing apparatus with a bonded-abrasive plate incorporating the above mechanism, debris can also be effectively discharged from a bonded-abrasive surface.

DETAILED DESCRIPTION OF THE INVENTION

Embodiments of the present invention will be described in detail below with reference to the drawings.

First Embodiment

Figure 1A:
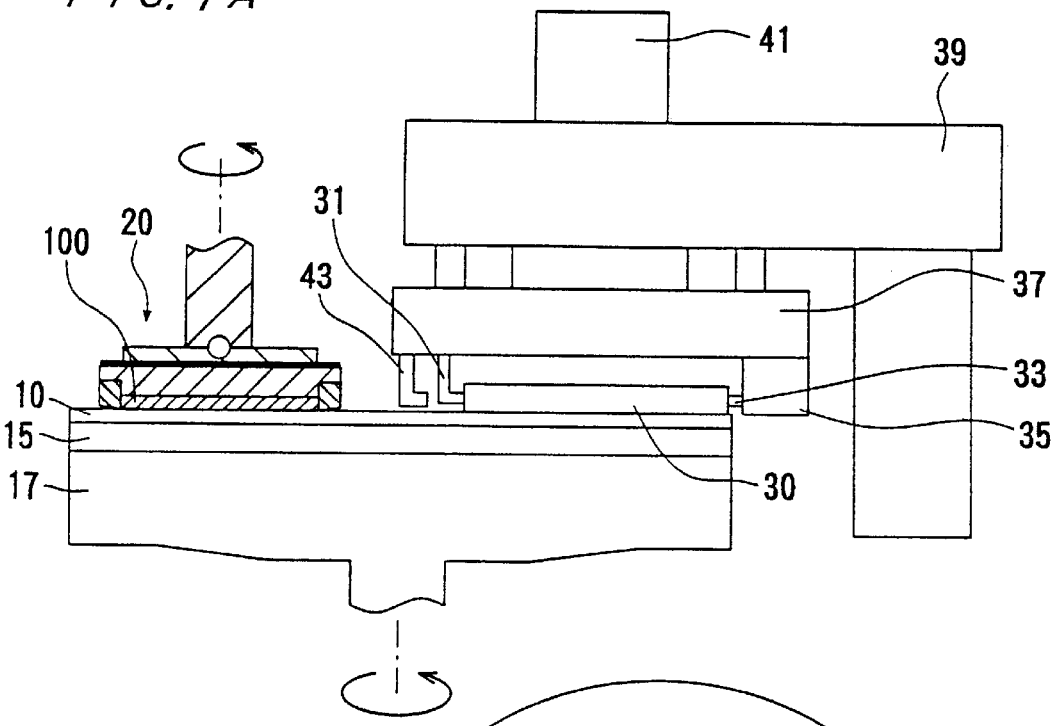
FIG. 1A is a fragmentary schematic side elevational view of a polishing apparatus according to a first embodiment of the present invention.
Figure 1B:
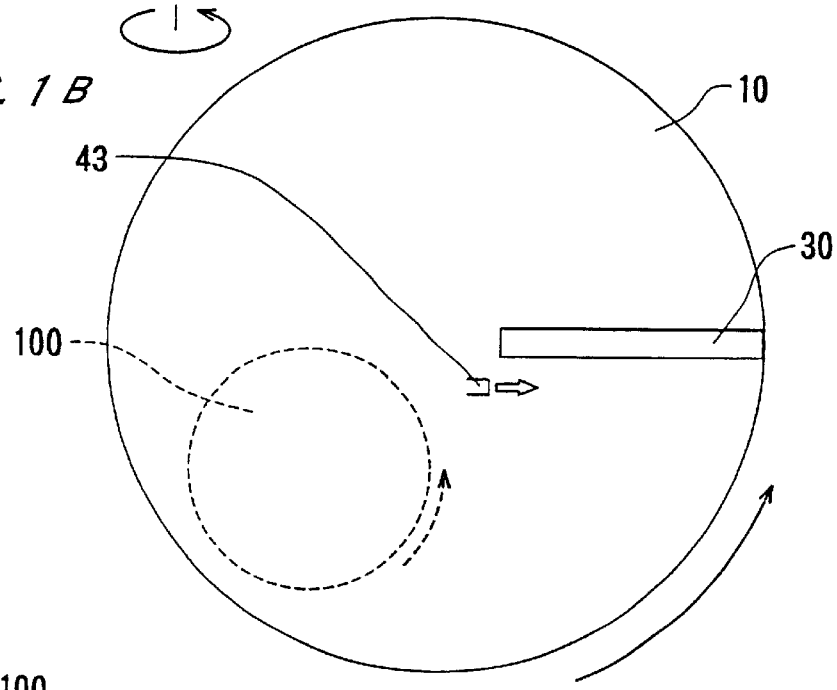
FIGS. 1B and 1C are a fragmentary schematic plan view and a perspective view, respectively, showing the positional relationship of a bonded-abrasive and a trapping jig.
Figure 1C:
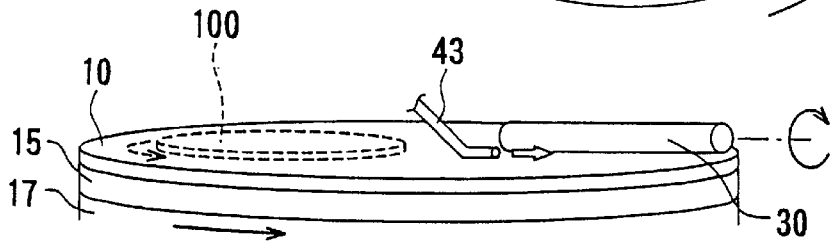

FIG. 1A is a fragmentary schematic side elevational view of a polishing apparatus according to a first embodiment of the present invention, and FIGS. 1B and 1C are fragmentary schematic plan and perspective views, respectively, showing the positional relationship of a bonded-abrasive and a trapping jig.

As shown in FIGS. 1A through 1C, the polishing apparatus has a disk-shaped bonded-abrasive element 10 mounted on a base 15, a top ring 20 disposed on an upper surface (bonded-abrasive surface) of the bonded-abrasive element 10 for holding a semiconductor wafer (workpiece to be polished) 100, a trapping jig 30 disposed on the upper surface of the bonded-abrasive element 10, and a fluid ejection nozzle 43 and other members disposed above the upper surface of the bonded-abrasive element 10. The components of the polishing apparatus will be described below.

The disk-shaped bonded-abrasive element 10 comprises abrasive particles, such as particles of CeO2, SiO2, Al2O3, ZrO2, MnO2, Mn2O3, or the like having an average diameter of 2 $\mu$m or less, which are bonded together by a binder, such as polyimide resin, phenolic resin, urethane, PVA (polyvinyl alcohol), or the like. The base 15 has an outer profile which is the same as the bonded-abrasive element 10, and is fixedly mounted on a rotary plate 17.

The semiconductor wafer 100 is mounted on the top ring 20 at a position horizontally spaced from the upper surface of the bonded-abrasive element 10. Then, the top ring 20 is moved to the illustrated position on the bonded-abrasive element 10 by an actuating mechanism (not shown).

The trapping jig (debris trapping means) 30 comprises a cylindrical brush or sponge (which may be another resilient material), and has opposite ends supported by axial support rods 31, 33. The trapping jig 30 is rotatable about its own axis by a motor 35 that is coupled to the axial support rod 33.

The motor 35 and the axial support rod 31 are fixed to a support base 37, which is suspended from an arm 39. When an air cylinder 41 mounted on the arm 39 is actuated, the support base 37 is moved vertically. The fluid ejection nozzle (debris discharging component) 43 is attached to the support base 37 in the vicinity of the axial support rod 31.

The semiconductor wafer 100 is polished at a position indicated by the dotted line in FIG. 1B. The trapping jig 30 is disposed downstream of the polishing position (with respect to the rotation of bonded-abrasive element 10), and extends radially outwardly from the center of the bonded-abrasive element 10.

The fluid ejection nozzle 43 is disposed immediately upstream of the trapping jig 30, and ejects a fluid (e.g., water) radially outwardly from the center of the bonded-abrasive element 10 along the trapping jig 30.

Operation of a mechanism for discharging debris produced when the semiconductor wafer 100 is polished will be described below. The semiconductor wafer 100 held by the top ring 20 is rotated and pressed against the rotating bonded-abrasive element 10 at its polishing position, and an abrasive liquid (water, a chemical liquid, or a liquid containing abrasive particles) is simultaneously supplied from an abrasive liquid supply mechanism to polish the surface of the semiconductor wafer 100 to be polished. Although not shown, before the semiconductor wafer 100 is polished or while the semiconductor wafer 100 is being polished, a dresser is pressed against the bonded-abrasive element 10 to dress the bonded-abrasive 10. Debris produced at this time remains attached to the surface of the bonded-abrasive element 10.

Then, the air cylinder 41 is actuated to lower the support base 37. As shown in FIGS. 1A through 1C, the trapping jig 30 is pressed against the surface of the bonded-abrasive element 10, and the motor 35 is simultaneously energized to rotate the trapping jig 30.

The debris that has been attached to the surface of the bonded-abrasive element 10 when the semiconductor wafer 100 has been polished is trapped by the trapping jig 30. The fluid ejection nozzle 43 ejects fluid to force the trapped debris off the surface of the bonded-abrasive element 10 and to discharge the trapped debris. The fluid may be ejected from the fluid ejection nozzle 43 all the time or intermittently while the trapping jig 30 is being pressed against the bonded-abrasive element 10. The fluid should preferably be ejected from the fluid ejection nozzle 43 under a pressure of 5 kgf/cm$^2$ or higher.

Figure 2:
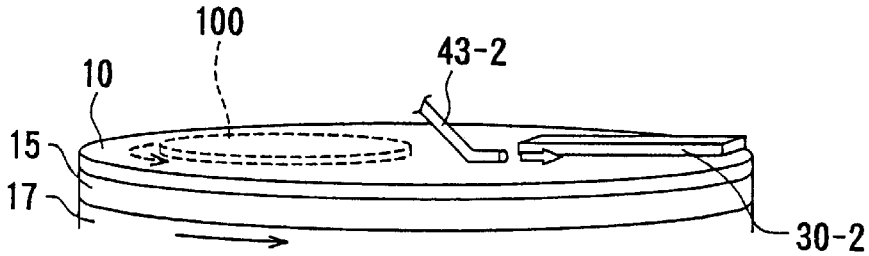
FIG. 2 is a view showing a modification of the structure shown in FIG. 1C.
Figure 3:
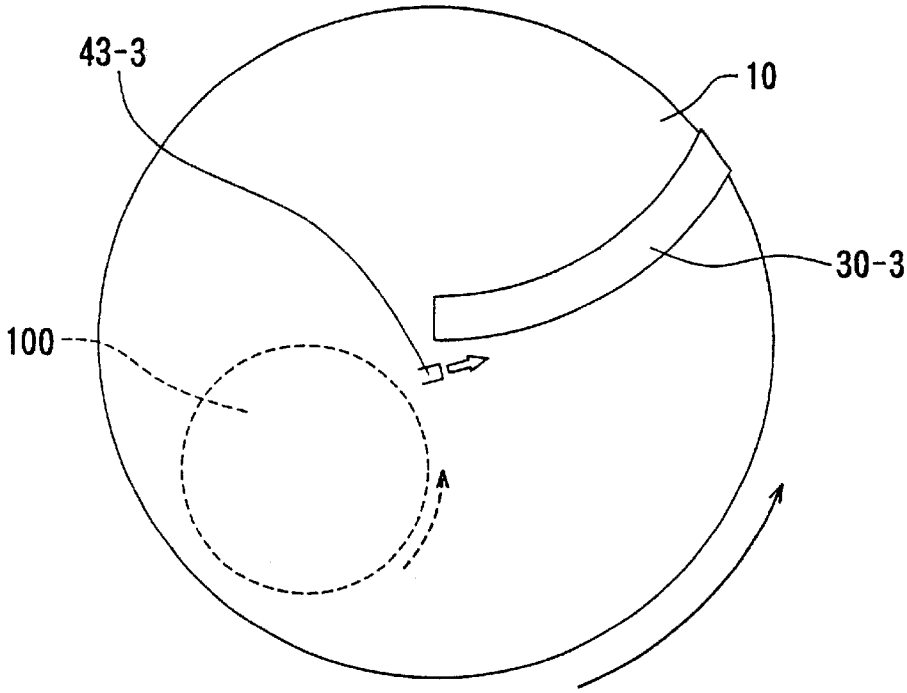
FIG. 3 is a view showing another modification of the structure shown in FIG. 1B.
Figure 4A:
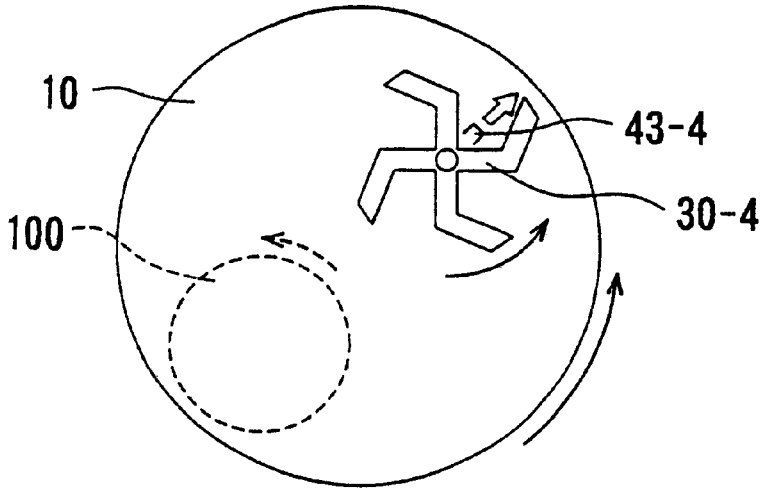
FIGS. 4A and 4B are views showing still another modification of the structure shown in FIG. 1C.
Figure 4B:
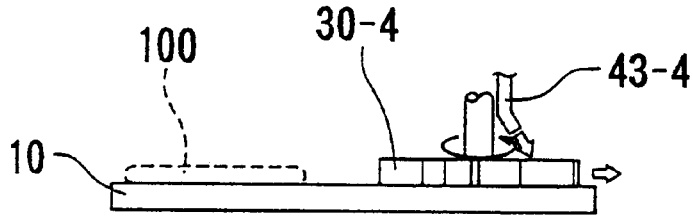

In the present embodiment, the trapping jig 30 has a cylindrical shape and is rotatable about its own axis. However, the trapping jig 30 is not necessarily rotated, but may simply be pressed against the abrasive surface of the bonded-abrasive element 10. In this modification, as shown in FIG. 2, a trapping jig 30-2 may be in the shape of a quadrangular prism. Alternatively, as shown in FIG. 3, a trapping jig 30-3 may be in the form of an arcuate rod. Further alternatively, as shown in FIGS. 4A and 4B, a trapping jig 30-4 may be in the form of a water wheel rotatable about its own central axis. In these modifications, fluid ejection nozzles 43-2, 3, 4 are placed in a position to discharge the trapped debris off of the surface of the bonded-abrasive element 10.

The trapping jig is not limited to the above structures, but may be of any of various structures and may operate according to any of various ways insofar as it serves as the debris trapping component capable of trapping debris produced on the bonded-abrasive surface when the semiconductor wafer is polished.

The fluid ejection nozzle is not limited to the above structures, but may be of any of various structures and may operate according to any of various ways as long as it serves as the debris discharging mechanism capable of discharging the debris trapped on the bonded-abrasive element by the debris trapping component off of the surface of the bonded-abrasive.

Second Embodiment

Figure 5A:
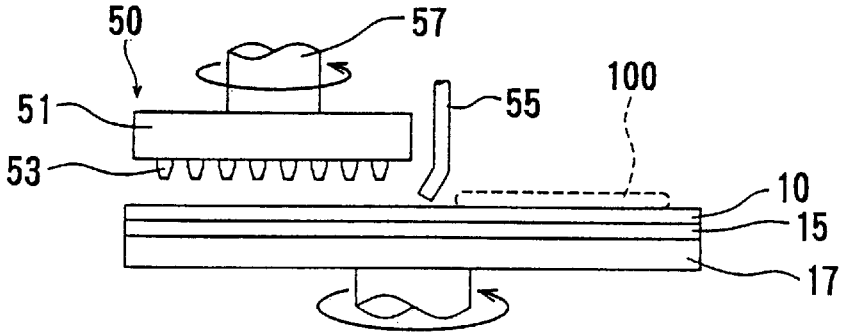
FIGS. 5A through 5C are views of a polishing apparatus according to a second embodiment of the present invention, FIG. 5A being a fragmentary schematic side elevational view of the polishing apparatus, FIG. 5B a fragmentary schematic plan view of the polishing apparatus, and FIG. 5C a fragmentary schematic plan view of a modification of the polishing apparatus.
Figure 5B:
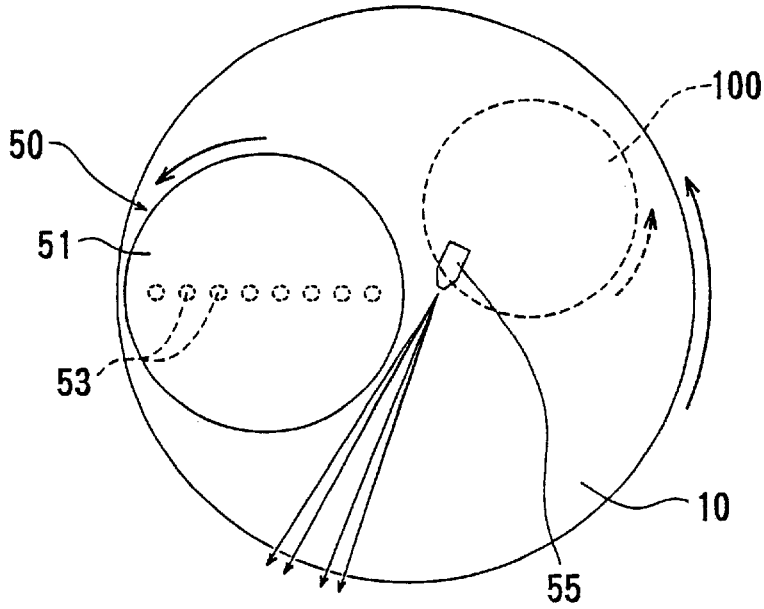
Figure 5C:
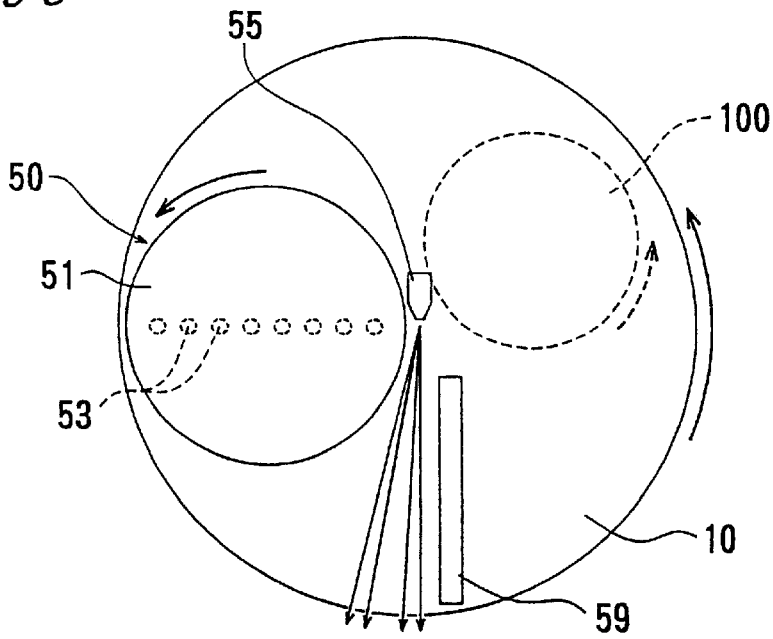

FIGS. 5A through 5C are views of a polishing apparatus according to a second embodiment of the present invention, FIG. 5A being a fragmentary schematic side elevational view of the polishing apparatus, FIG. 5B a fragmentary schematic plan view of the polishing apparatus, and FIG. 5C a fragmentary schematic plan view of a modification of the polishing apparatus.

The polishing apparatus according to the second embodiment is identical to the polishing apparatus shown in FIGS. 1A through 1C in that the base 15 and the bonded-abrasive element 10 are mounted on the rotary plate 17 for rotation, and the semiconductor wafer 100 is held against the surface of the bonded-abrasive element 10 by a top ring (not shown) and rotated thereby. The details of these common structures will not be described below.

In the embodiment shown in FIGS. 5A and 5B, the polishing apparatus has a fluid applying component 50 for applying a fluid (a liquid or gas) to the surface of the bonded-abrasive element 10 while the semiconductor wafer 100 is being polished.

The fluid applying component 50 comprises a disk-shaped nozzle support plate 51 and a linear array of eight fluid ejection nozzles 53 attached centrally to a lower surface of the nozzle support plate 51. The fluid ejection nozzles 53 eject water under high pressure or the like. The pressure of the ejected water should be at a level of a water jet, e.g., preferably about 2 MPa or higher. The nozzle support plate 51 can be rotated by a drive shaft 57.

The polishing apparatus also has another main fluid ejection nozzle (debris discharging component) 55 disposed downstream of the fluid applying component 50. The fluid ejection nozzle 55 is arranged to eject a fluid (e.g., water) radially outwardly from the center of the surface of the bonded-abrasive element 10.

The semiconductor wafer 100 held by a top ring (not shown) is held against the bonded-abrasive element 10 at a position indicated by the dotted line, and is rotated. At the same time, the bonded-abrasive element 10 is rotated in the direction indicated by the arrow so as to polish the surface of the semiconductor wafer 100. Alternatively, before the semiconductor wafer 100 is polished or while the semiconductor wafer 100 is being polished, the bonded-abrasive element 10 is dressed by a dresser. At this time, while the nozzle support plate 51 is being rotated in the direction indicated by the arrow, a fluid such as water is ejected under high pressure from the fluid ejection nozzles 53 to the surface of the bonded-abrasive element 10. Debris which has been entrapped by small surface irregularities of the bonded-abrasive element 10 when the semiconductor wafer 100 has been polished and/or the bonded-abrasive element 10 has been dressed is lifted, and is discharged together with the fluid from the surface of the bonded-abrasive element 10.

Since the fluid ejection nozzle 55 is disposed downstream of the fluid applying means 50 (with respect to the rotation of the bonded-abrasive element 10) and ejects the fluid radially outwardly of the bonded-abrasive element 10, the debris is further effectively discharged from the surface of the bonded-abrasive element 10.

As shown in FIG. 5C, a trapping jig 59 which is identical to the trapping jig according to the first embodiment may be disposed downstream of the fluid ejection nozzle 55 for more effectively discharging the debris.

In the present embodiment, the fluid ejection nozzle 55 and the trapping jig 59 may not necessarily be required, because the fluid applying component 50 alone is capable of discharging the debris.

The fluid applying component 50 is not limited to the above structure, and may be modified in various ways insofar as it applies a liquid or gas to the bonded-abrasive surface while the semiconductor wafer is being polished to remove the debris from the bonded-abrasive surface.

Third Embodiment

Figure 6A:
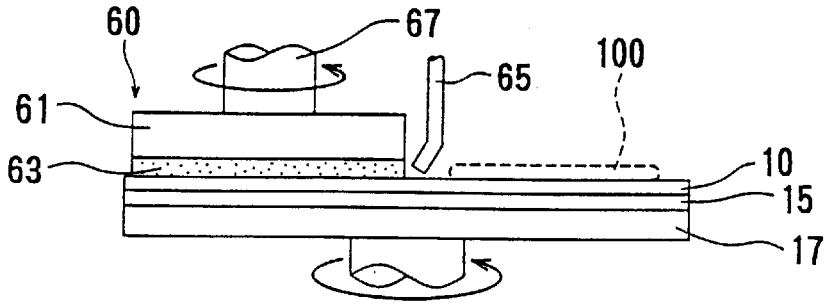
FIGS. 6A through 6C are views of a polishing apparatus according to a third embodiment of the present invention, FIG. 6A being a fragmentary schematic side elevational view of the polishing apparatus, FIG. 6B a fragmentary schematic plan view of the polishing apparatus, and FIG. 6C a fragmentary schematic plan view of a modification of the polishing apparatus.
Figure 6B:
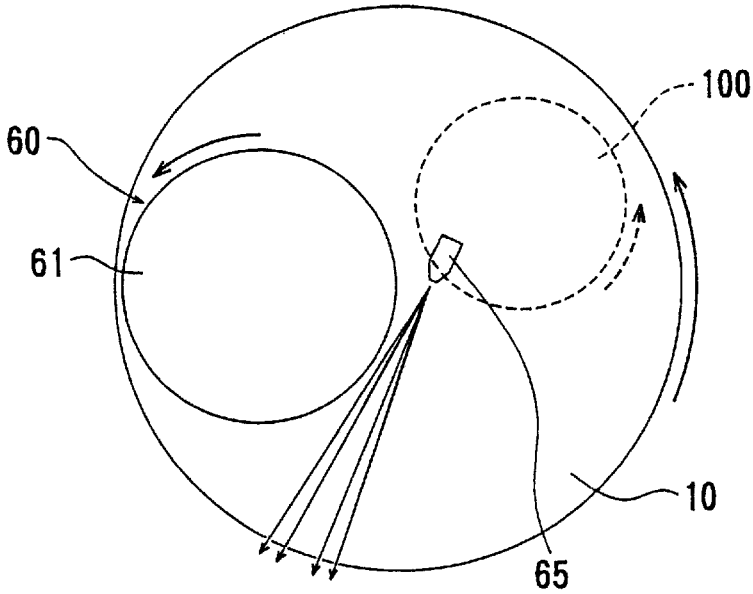
Figure 6C:
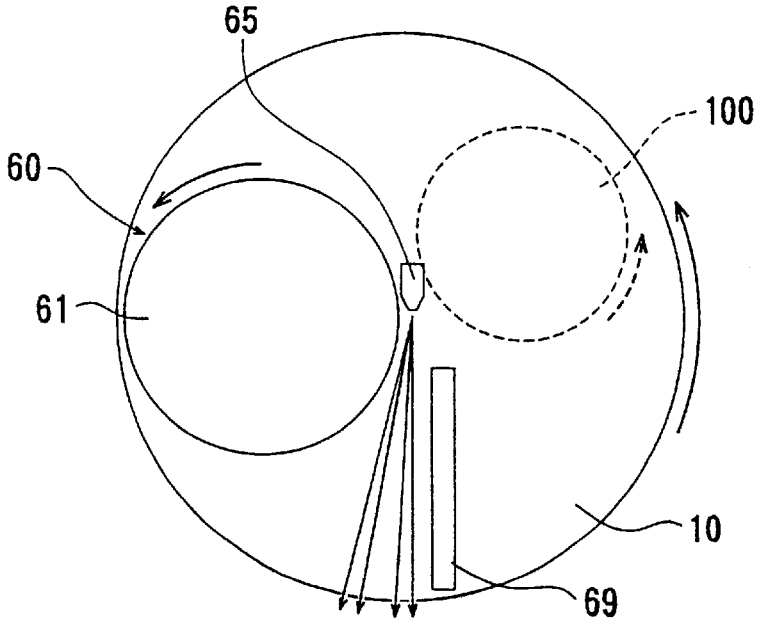

FIGS. 6A through 6C are views of a polishing apparatus according to a third embodiment of the present invention, FIG. 6A being a fragmentary schematic side elevational view of the polishing apparatus, FIG. 6B a fragmentary schematic plan view of the polishing apparatus, and FIG. 6C a fragmentary schematic plan view of a modification of the polishing apparatus.

The polishing apparatus according to the third embodiment is identical to the polishing apparatus shown in FIGS. 1A through 1C in that the base 15 and the bonded-abrasive element 10 are mounted on the rotary plate 17 for rotation, and the semiconductor wafer 100 is held against the bonded-abrasive element 10 by a top ring (not shown) and rotated thereby. The details of these common structures will not be described below.

The polishing apparatus shown in FIGS. 6A and 6B has a dressing component 60 disposed on the surface of the bonded-abrasive element 10, for dressing the bonded-abrasive element 10 while the semiconductor wafer 100 is thereby being polished.

The dressing component 60 comprises a disk-shaped support plate 61 and a disk-shaped dressing plate 63 attached to a lower surface of the support plate 61. The dressing plate 63 comprises a diamond of #400 electrodeposited on a surface of a metal sheet. The support plate 61 is rotatable by a drive shaft 67.

The polishing apparatus also has a fluid ejection nozzle (debris discharging component) 65 disposed downstream of the dressing component 60.

The semiconductor wafer 100 held by a top ring (not shown) is held against the bonded-abrasive element 10 at a position indicated by the dotted line and rotated to polish the surface of the semiconductor wafer 100 to be polished. At the same time, the dressing component 60 is rotated in the direction indicated by the arrow to dress the surface of the bonded-abrasive element 10.

When the surface of the bonded-abrasive element 10 is dressed, debris which has been entrapped by small surface irregularities of the bonded-abrasive element 10 when the semiconductor wafer 100 has been polished is displaced onto the surface of the bonded-abrasive element 10. The fluid ejection nozzle 65 disposed downstream of the dressing component 60 ejects the fluid radially outwardly with respect to the bonded-abrasive element 10, discharging the debris together with the fluid effectively from the surface of the bonded-abrasive element 10.

As shown in FIG. 6C, a trapping jig 69 which is identical to the trapping jig according to the first embodiment may be disposed downstream of the fluid ejection nozzle 65 for more effectively discharging the debris.

The dressing component 60 is not limited to the above structure, and may be of any structure as long as it is capable of dressing the bonded-abrasive surface. The fluid ejection nozzle 65 and the trapping jig 69 may have any structure capable of discharging the debris, which has been displaced onto the bonded-abrasive surface by the dressing component.

Fourth Embodiment

Figure 7A:
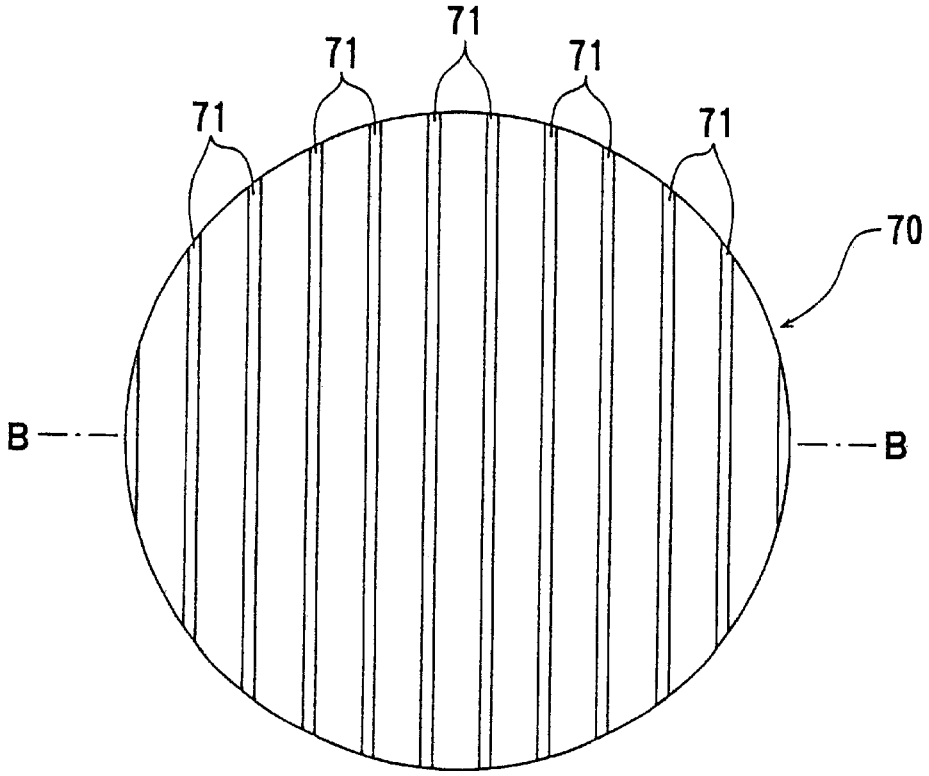
FIGS. 7A and 7B are views showing a bonded-abrasive 70 used in a polishing apparatus according to a fourth embodiment of the present invention, FIG. 7A being a plan view of the bonded-abrasive, and FIG. 7B a sectional side elevational view thereof, i.e., a cross-sectional view taken along line B—B of FIG. 7A.
Figure 7B:
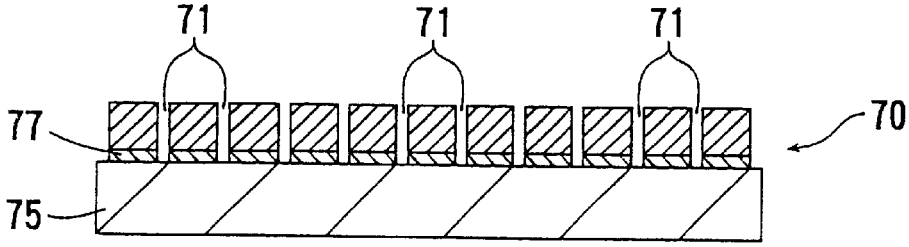

FIGS. 7A and 7B are views showing a bonded-abrasive element 70 used in a polishing apparatus according to a fourth embodiment of the present invention. FIG. 7A is a plan view of the bonded-abrasive element, and FIG. 7B is a sectional side elevational view thereof, i.e., a cross-sectional view taken along line B—B of FIG. 7A.

The bonded-abrasive element 70 according to the present embodiment has a number of parallel grooves (debris discharging components) 71 for discharging debris which is lodged in the abrasive surface of the bonded-abrasive element 70.

The bonded-abrasive element 70 has a disk shape and is attached to a disk-shaped base 75 by an adhesive 77, the bonded-abrasive element 70 having substantially the same dimensions and shape as the base 75. The bonded-abrasive element 70 and the adhesive 77 are cut along parallel lines to form the grooves 71. The bonded-abrasive element 70 has a thickness of 5 mm and an outside diameter of 60 mm. The grooves 71 have a width of 2 mm each, and are spaced by a pitch ranging from 20 to 100 mm.

In the present embodiment, debris produced when the surface of a workpiece is polished can be discharged simply when an usual polishing process is carried out by pressing the workpiece against the abrasive surface of the bonded-abrasive element 70 and by moving the workpiece and the bonded-abrasive element 70 relative to each other.

Figure 8A:
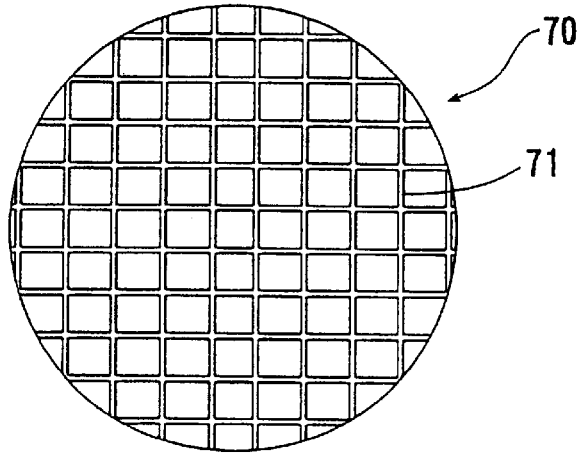
FIGS. 8A, 8B, and 8C are views showing respective modifications of the bonded-abrasive.
Figure 8B:
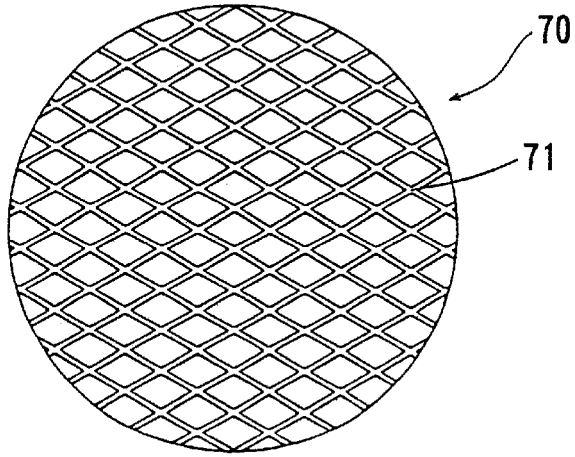
Figure 8C:
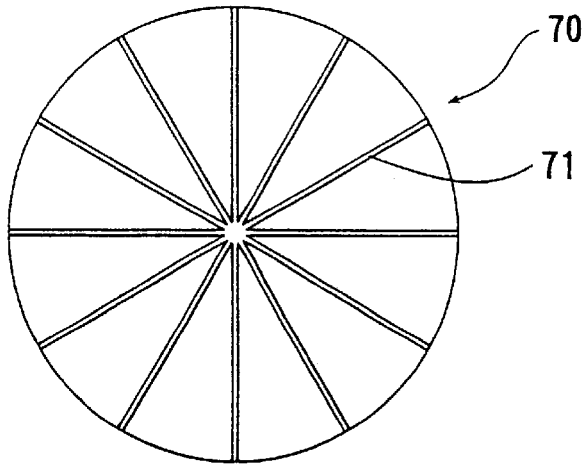

Specifically, a semiconductor wafer (not shown) held by a top ring is pressed against the surface of the bonded-abrasive element 70. While an abrasive liquid (solution) is being supplied to the abrasive surface of the bonded-abrasive element 70, the bonded-abrasive element 70 is rotated and the semiconductor wafer is simultaneously rotated to polish the semiconductor wafer. Debris that is produced falls into the grooves 71, and is discharged together with the abrasive liquid out of the grooves 71. The grooves 71 may be arranged in a grid pattern as shown in FIG. 8A, a lozenge pattern as shown in FIG. 8B, or a radial pattern as shown in FIG. 8C.

Figure 9A:
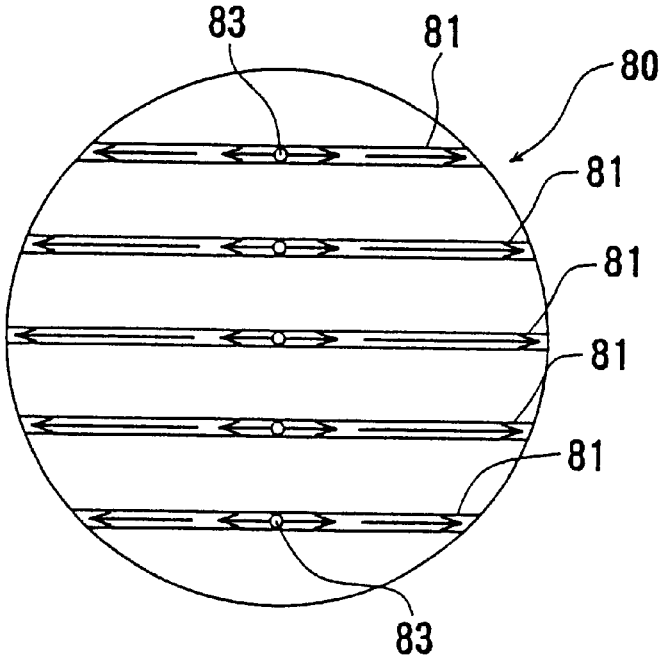
FIGS. 9A through 9C are views showing a bonded-abrasive 80 according to a modification, FIG. 9A being a plan view of the bonded-abrasive, FIG. 9B an enlarged view of a groove 81 of the bonded-abrasive, illustrating the manner in which the bonded-abrasive operates, and FIG. 9C a view of the groove shown in FIG. 9B, taken along a line perpendicular to the plane of the view shown in FIG. 9B, illustrating the manner in which the bonded-abrasive operates.
Figure 9B:
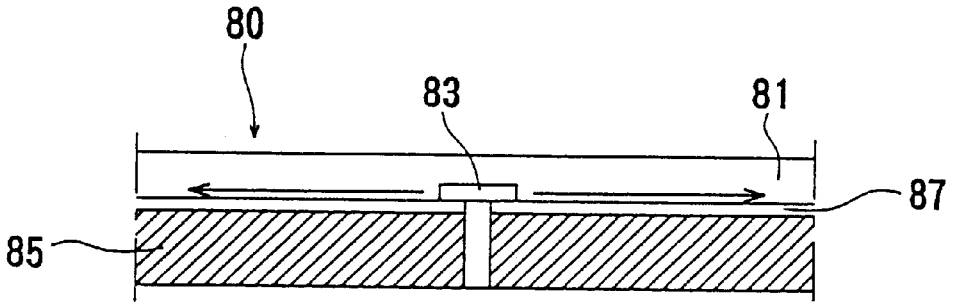
Figure 9C:
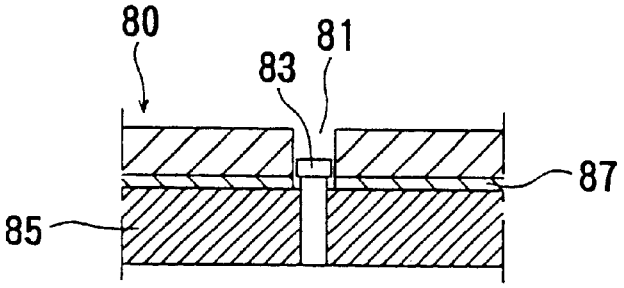

FIGS. 9A through 9C are views showing a bonded-abrasive element 80 according to a modification, FIG. 9A being a plan view of the bonded-abrasive element, FIG. 9B being an enlarged view of a groove 81 of the bonded-abrasive, illustrating the manner in which the bonded-abrasive operates, and FIG. 9C being a view of the groove shown in FIG. 9B, taken along a line perpendicular to the plane of the view shown in FIG. 9B, illustrating the manner in which the bonded-abrasive operates.

The bonded-abrasive element 80 according to the present embodiment has a number of parallel grooves 81 for discharging debris, which are defined in the abrasive surface of the bonded-abrasive element 80 that is attached to a base 85 by an adhesive 87. The bonded-abrasive element 80 also has a fluid ejection nozzle (fluid ejecting nozzle) 83 disposed centrally in each of the grooves 81 for ejecting a fluid (a liquid or gas) in and through each groove 81 in opposite directions to discharge debris out of each groove 81.

A semiconductor wafer (not shown) held by a top ring is pressed against the surface of the bonded-abrasive element 80. While an abrasive liquid (solution) is being supplied to the abrasive surface of the bonded-abrasive element 80, the bonded-abrasive element 80 is rotated and the semiconductor wafer is simultaneously rotated to polish the semiconductor wafer. Debris that is produced falls into the grooves 81, and is discharged together with the abrasive liquid out of the grooves 81. Since fluid such as water is simultaneously ejected from the fluid ejection nozzle 83 in and along each groove 81 in opposite directions, the debris in the grooves 81 can reliably be discharged from the grooves 81.

The shape of the grooves 81, and the shape, structure, and position of the fluid ejection nozzle may be modified in various ways.

Figure 10A:
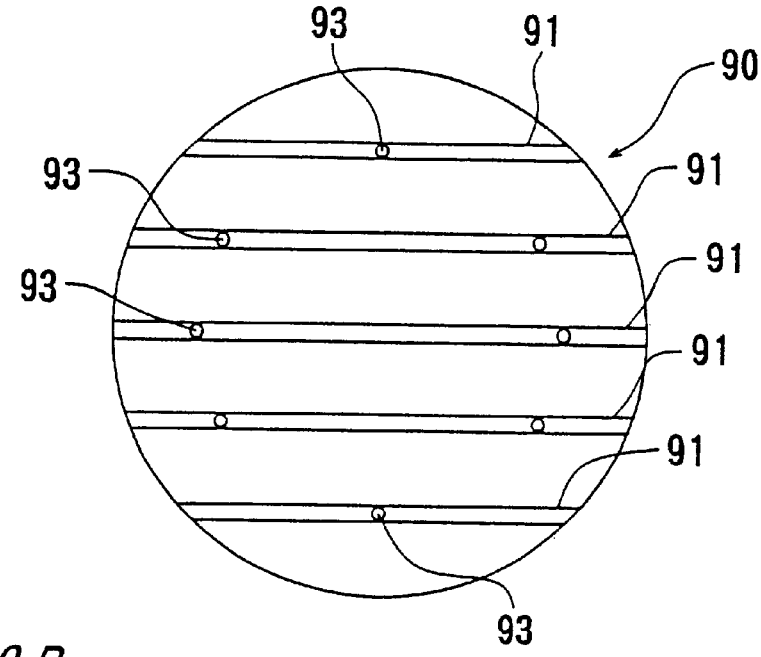
FIGS. 10A through 10C are views showing a bonded-abrasive 90 according to another modification, FIG. 10A being a plan view of the bonded-abrasive, FIG. 10B an enlarged view of a groove 81 of the bonded-abrasive, illustrating the manner in which the bonded-abrasive operates, and FIG. 10C a view of the groove shown in FIG. 10B, taken along a line perpendicular to the plane of the view shown in FIG. 10B, illustrating the manner in which the bonded-abrasive operates.
Figure 10B:
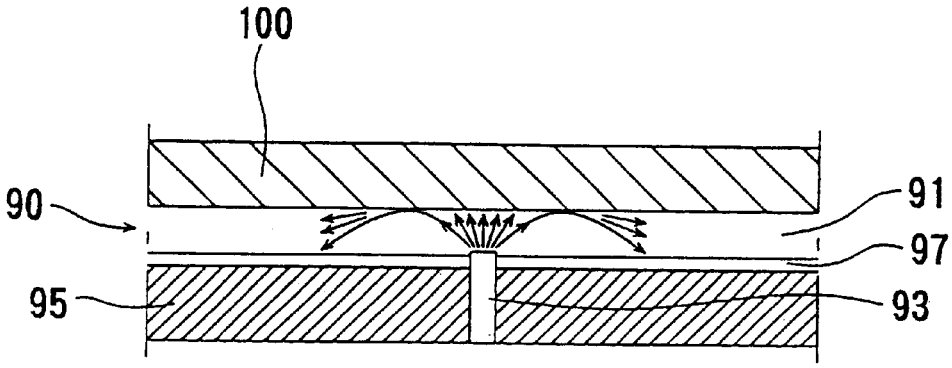
Figure 10C:
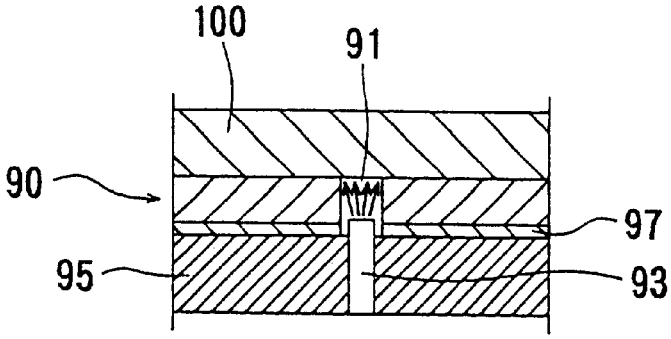

FIGS. 10A through 10C are views showing a bonded-abrasive element 90 according to another modification, FIG. 10A being a plan view of the bonded-abrasive element, FIG. 10B being an enlarged view of a groove 91 of the bonded-abrasive element, illustrating the manner in which the taken along a line perpendicular to the plane of the view shown in FIG. 10B, illustrating the manner in which the bonded-abrasive operates.

The bonded-abrasive element 90 according to the present embodiment has a number of parallel grooves 91 for discharging debris which are defined in the abrasive surface of the bonded-abrasive element 90 that is attached to a base 95 by an adhesive 97. The bonded-abrasive element 90 also has fluid ejection nozzles (fluid ejecting components) 93 disposed in the grooves 91 for ejecting a fluid (a liquid or gas) toward the surface to be polished of the semiconductor wafer 100 placed on the bonded-abrasive element 90, i.e., vertically upwardly from the abrasive surface of the bonded-abrasive element 90. The fluid ejection nozzles 93 are disposed in a ring pattern within the path along which the semiconductor wafer 100 is polished.

The semiconductor wafer 100 held by a top ring is pressed against the surface of the bonded-abrasive 90. While an abrasive liquid (solution) is being supplied to the bonded-abrasive element 90, the bonded-abrasive element 90 is rotated and the semiconductor wafer 100 is simultaneously rotated to polish the semiconductor wafer 100. Debris that is produced falls into the grooves 91, and is discharged together with the abrasive liquid out of the grooves 91. Since fluid such as water is simultaneously ejected from the fluid ejection nozzle 93 to the surface of the semiconductor wafer 100 to be polished, the debris attached to the semiconductor wafer 100 can be washed off. Therefore, the debris can more effectively be discharged.

The fluid is intermittently ejected from the fluid ejection nozzles 93 only when the semiconductor wafer 100 is positioned immediately above the fluid ejection nozzles 93. The shape of the grooves 91, and the shape, structure and position of the fluid ejection nozzles 93 may be modified in various ways.

The mechanism for discharging debris produced when the workpiece is polished according to the fourth embodiment is applicable not only to the table-type polishing apparatus shown in FIGS. 1A through 1C, but also to a scroll-type polishing apparatus. The application of the mechanism to a scroll-type polishing apparatus will be described below.

Figure 11:
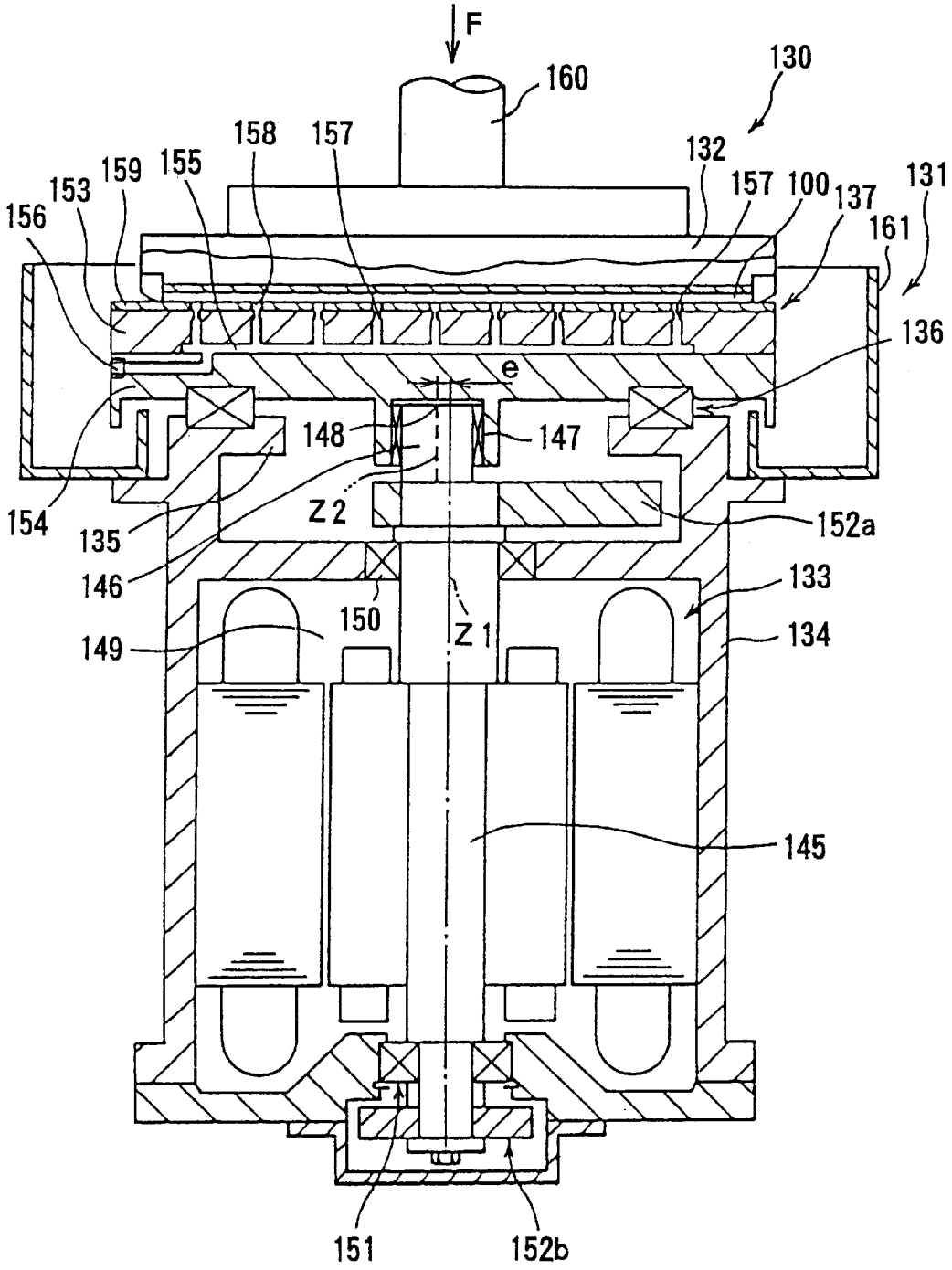
FIG. 11 is a vertical cross-sectional view of a scroll-type polishing apparatus.
Figure 12A:
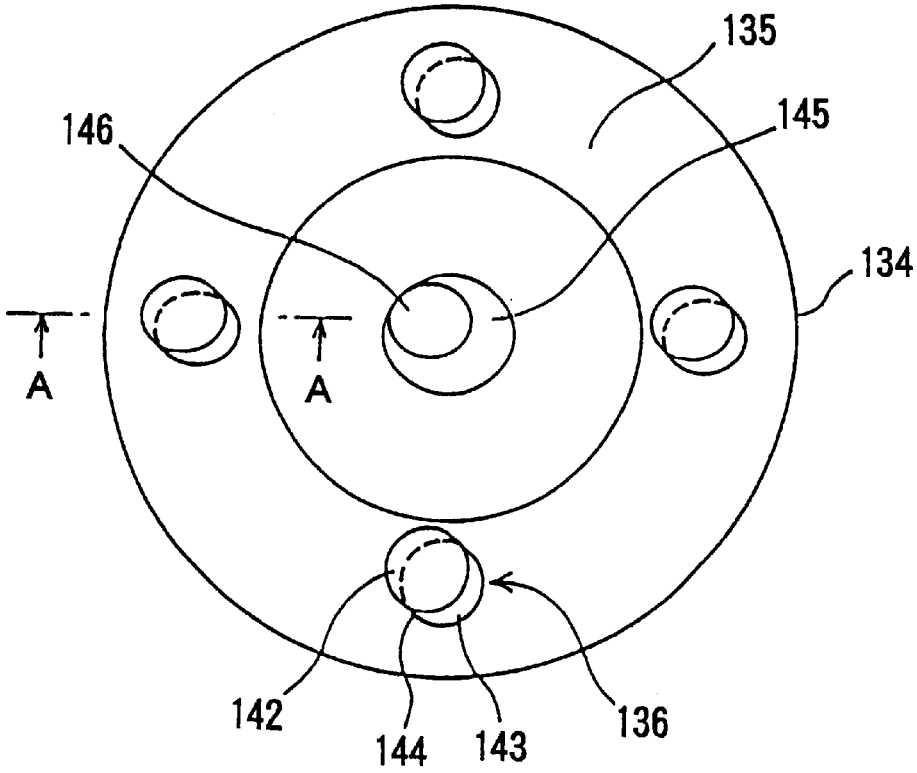
FIGS. 12A and 12B are views showing a scrolling motion, FIG. 12A being a plan view and FIG. 12B a cross-sectional view taken along line A—A of FIG. 12A.
Figure 12B:
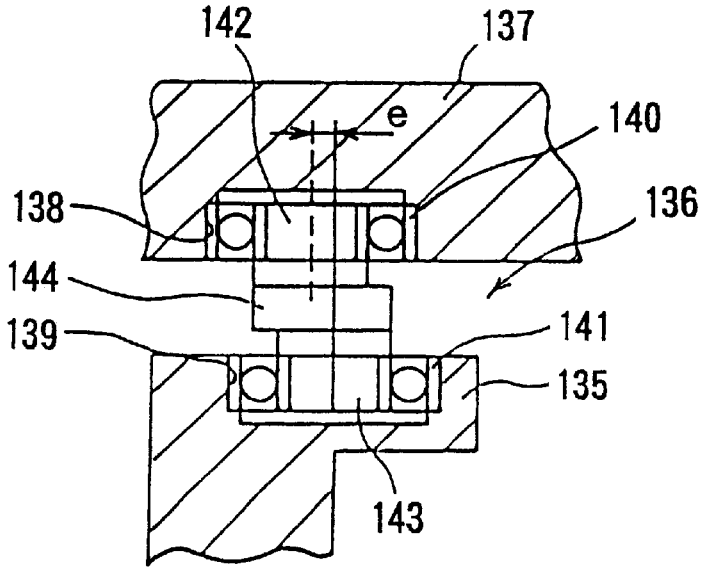

FIGS. 11 and 12A, 12B are views showing a circulatory translational motion mechanism of a scroll-type polishing apparatus. A circulatory translational motion (scrolling motion) is made by two surfaces which move in a circulatory pattern such as a circular pattern while in a translational pattern without changing their facing attitude. This mechanism allows a bonded-abrasive plate to be slightly greater than a substrate to be polished. Therefore, it is easy to manufacture a highly planar bonded-abrasive plate, a motor for actuating the bonded-abrasive plate may be small in size, and the mechanism may be compact and take up a small area. The mechanism comprises a translational table assembly 131 which provides a polishing tool surface that makes circulatory translational motion, and a top ring 132 for holding a wafer 100 with the surface to be polished being directed downwardly and pressing the wafer 100 against the polishing tool surface under a given pressure.

The translational table assembly 131 has a tubular casing 134 housing a motor 133 therein, an annular support plate 135 projecting inwardly from an upper portion of the tubular casing 134, three or more supports 136 circumferentially spaced and mounted on the annular support plate 135, and a reference plate 137 supported on the supports 136. Upper surfaces of the supports 136 and a lower surface of the reference plate 137 have a plurality of recesses 138, 139 spaced at equal intervals in the circumferential direction, and bearings 140, 141 are mounted in the respective recesses 138, 139. As shown in FIG. 12B, a joint 144 has two shafts 142, 143 that are displaced by a distance "e" from each other, and these shafts 142, 143 have ends mounted respectively in the bearings 140, 141, allowing the reference plate 137 to make a circulatory translational motion along a circle having a radius "e".

The reference plate 137 has a recess 148 defined centrally in a lower surface thereof and which houses a bearing 137 which supports a drive end 146 that is positioned eccentrically on the upper end of a main shaft 145 of the motor 133. The drive end 146 is displaced eccentrically from the main shaft 145 by a distance "e". The motor 133 is housed in a motor chamber 149 defined in the casing 134, and the main shaft 145 thereof is supported by upper and lower bearings 150, 151. Counterbalances 152*a*, 152*b* for bringing the eccentric load into balance are mounted on the main shaft 145.

The reference plate 137 has a diameter which is slightly greater than the sum of the diameter of the wafer 100 to be polished and the distance "e". The reference plate 137 comprises two plate members 153, 154 joined to each other with a space 155 defined therebetween for the passage therein of an abrasive liquid such as water, a chemical liquid, or the like to be supplied to the surface to be polished. The space 155 communicates with an abrasive liquid supply port 156 defined in a side of the reference plate 137 and also with a plurality of liquid outlet holes 157 defined in an upper surface of the reference plate 137. A bonded-abrasive plate 159 is applied to the upper surface of the reference plate 137. The bonded-abrasive plate 159 has a plurality of outlet holes 158 defined therein which are aligned with the respective liquid outlet holes 157 in the bonded-abrasive plate 159. The outlet holes 157, 158 are usually distributed substantially uniformly over the entire surfaces of the reference plate 137 and the bonded-abrasive plate 159.

The top ring 132, which serves as a pressing device, is mounted on the lower end of a shaft 160 so as to be tiltable to a certain extent in conformity with the surface to be polished. A pressing force from an air cylinder (not shown) and a rotational force from a motor (not shown) are applied through the shaft 160 to the top ring 132. The top ring 132 has a substrate holder 161 on its lower end with a resilient sheet 162 mounted therein. A retrieval tank 163 for retrieving a liquid supplied to the surface to be polished is disposed around an upper portion of the casing 134.

A polishing process carried out by the polishing apparatus shown in FIGS. 11 and 12A, 12B will be described below. When the motor 133 is energized, the reference plate 137 makes a translational circular motion, and the wafer 100 attached to the top ring 132 is pressed against the surface of the bonded-abrasive plate 159 attached to the reference plate 137. An abrasive liquid is supplied via the abrasive liquid supply port 156, the space 155, and the outlet holes 157, 158 to the polishing surface. Specifically, the abrasive liquid is supplied via grooves in the surface of the bonded-abrasive plate 159 to the polishing surface thereof which is held against the wafer 100.

At this time, a small relative translational circular motion having a radius "e" is developed between the polishing surface of the bonded-abrasive plate 159 and the surface to be polished of the wafer 100, uniformly polishing the entire surface of the wafer 100. If the surface to be polished and the polishing surface remain in the same positional relation to each other, then since the surface to be polished is affected by local variations of the polishing surface, the top ring 132 is gradually rotated about its own axis to prevent the surface of the wafer 100 from being polished only by one local region of the bonded-abrasive plate 159.

Fifth Embodiment

Figure 13A:
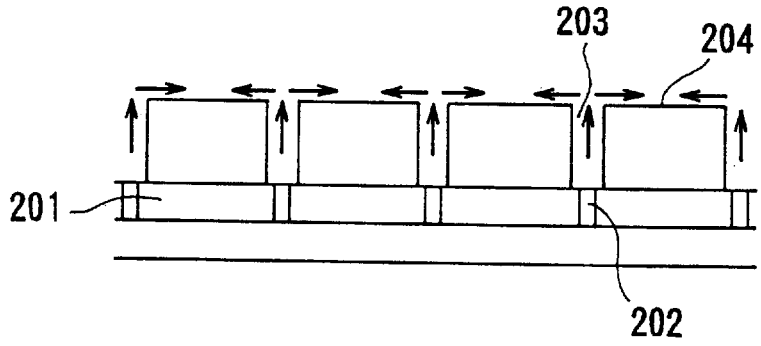
FIGS. 13A through 13C are views showing the structure of grooves according to a fifth embodiment of the present invention, FIGS. 13A and 13B being cross-sectional views, and FIG. 13C a plan view.
Figure 13B:
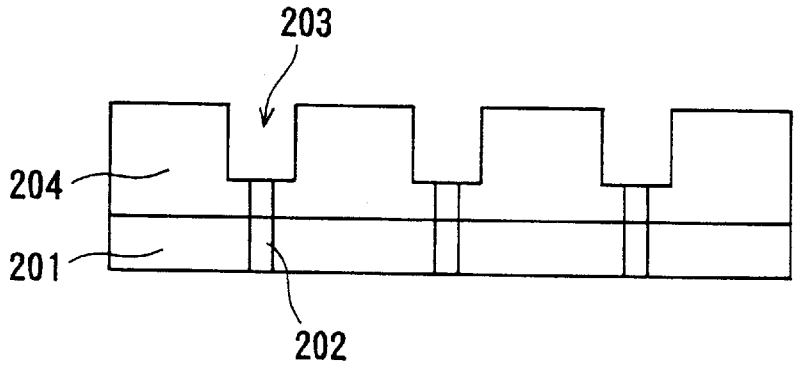

Since the scroll-type polishing apparatus performs the polishing process with the scrolling motion, as described above, it suffices for the bonded-abrasive surface to move in a range of the scrolling motion with respect to the size of the wafer to be polished. However, it is difficult to supply a liquid required for the polishing process from an external source, as is the case with the table-type polishing apparatus. Consequently, a liquid required for the polishing process needs to be supplied to the polishing surface from the bonded-abrasive surface, which is located below the wafer. As shown in FIG. 13A, a base plate 201 has a plurality of liquid supply holes 202 defined therein for supplying a liquid therethrough to respective grooves 203 above the liquid supply holes 202. To form grooves in a disk-shaped bonded-abrasive element, grooves may not be defined all the way through a bonded-abrasive element 204, as shown in FIG. 13A, and shallow grooves 203 may be defined in the bonded-abrasive 204, leaving bottoms therein, as shown in FIG. 13B. Then flow passages for supplying a liquid to the grooves in the bonded-abrasive may be defined from the side of the base plate 201 in alignment with the shallow grooves 203.

Figure 13C:
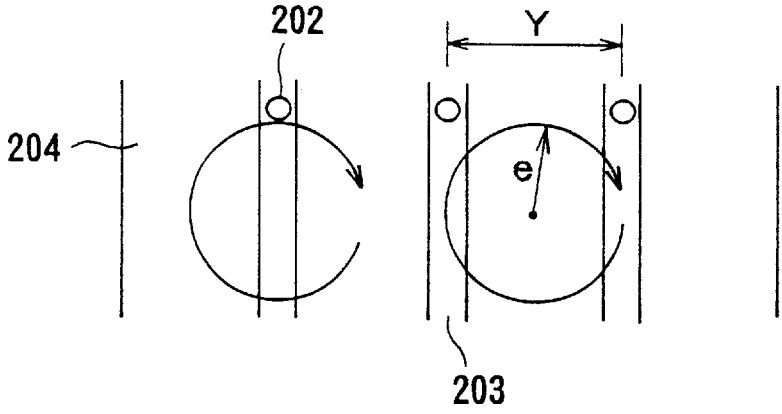

The grooves have a width ranging from 1 to 3 mm each, and are spaced by a pitch Y (distance between adjacent grooves) of about 20 mm. The grooves may be defined by slotting the disk-shaped bonded-abrasive element after the disk-shaped bonded-abrasive element is bonded to the base plate, and may alternatively be defined by producing plate-like bonded-abrasive pieces and applying them to the base plate. As shown in FIG. 13C, the pitch Y is the same as or smaller than twice the scrolling diameter e. If the pitch Y were greater than twice the scrolling diameter e, then there would be developed a region where no grooves pass over the surface to be polished even when the polishing surfaces make a scrolling motion. Stated otherwise, the surface to be polished would have a region which does not contact grooves at any time during the scrolling motion, and debris from the region of the surface to be polished would not be discharged into the groove. As a result, the debris that remains unremoved adversely affects the in-plane uniformity of the surface to be polished.

In the scroll-type polishing apparatus, the water or chemical liquid needs to be supplied to the interface between the bonded-abrasive surface and the surface to be polished of the wafer for promoting a chemical polishing action and also for reducing the frictional resistance to the polishing surface to suppress the problem of increased vibrations for thereby increasing the mechanical stability of the polishing apparatus. The abrasive liquid supplied to the polishing surface is also effective to cool the polishing surface. When the abrasive liquid is supplied to the bonded-abrasive surface, the groove configuration shown in FIG. 13A or 13B allows the abrasive liquid to flow along the grooves 203 and out of the grooves 203, failing to supply the abrasive liquid to the polishing surface of the bonded-abrasive when the wafer is polished thereby. If the lubricating and cooling action based on the abrasive liquid is lost when the wafer is polished, the polishing capability of the polishing apparatus is adversely affected, making it difficult to polish the wafer uniformly. If no liquid is present on the bonded-abrasive surface when it is dressed, then the bonded-abrasive surface cannot be dressed as desired. Therefore, it is necessary that an adequate amount of liquid be present on the polishing surface of the bonded-abrasive while the wafer is being polished and also while the bonded-abrasive element is being dressed.

Figure 14A:
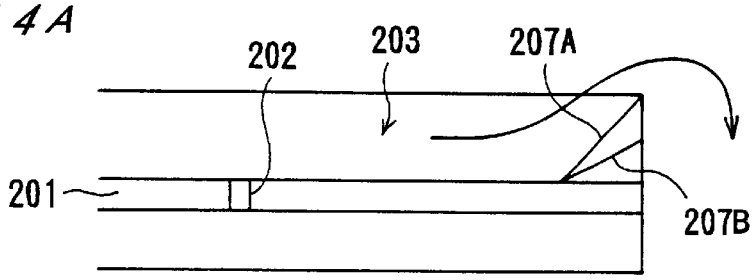
FIGS. 14A through 14C are views showing sloping barriers, FIG. 14A being a cross-sectional view of the sloping barriers, FIG. 14B a plan view of the sloping barriers, and FIG. 14C a plan view showing the structure of sloping barriers with a discharge passage defined centrally therein.
Figure 14B:
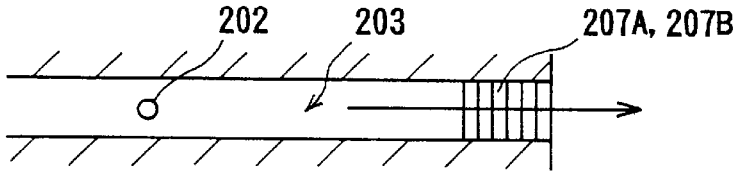

FIGS. 14A and 14B are views of the bonded-abrasive element 204, showing sloping barriers 207A, 207B on an end of each of the grooves 203 defined therein. The sloping barrier 207A has a height reaching the bonded-abrasive surface and serves to provide a full-height blockade in the groove to the liquid in the groove 203, while allowing the groove to overflow the barrier. The sloping barrier 207B provides a half-height blockade in the groove 203. When the groove 203 is supplied with the liquid from below the bonded-abrasive element, if the groove has a small width, then since the liquid tends to overflow the groove 203, the barrier is not necessarily required. If the groove 203 has a large width, however, the barrier is required, and the barriers shown in FIGS. 14A and 14B are effective to block the fluid in the groove 203. As described above, if the groove 203 is sufficiently small in width, then a sufficient amount of liquid can be supplied to the polishing surface without the need for barriers. However, if the groove 203 is wider and a sufficient amount of liquid cannot be supplied to the polishing surface from below the bonded-abrasive due to a shortage of liquid pressure, then the barriers 207A, 207B are effective to cause the liquid in the groove to overflow the groove 203 easily, thus supplying a sufficient amount of water, chemical liquid, or the like to the polishing surface when the wafer is polished, or supplying a sufficient amount of water or the like to the bonded-abrasive when the bonded-abrasive is dressed. Debris produced by the polishing process, such as waste bits produced by the polishing process, large grain fragments separated from the bonded-abrasive element when the bonded-abrasive element is dressed, or diamond particles released from the dresser, is discharged out by the liquid that is supplied to lubricate and cool the polishing surface. Since the barriers 207A, 207B have sloping surfaces, they allow the debris to be discharged easily together with the liquid out of the groove 203.

Figure 14C:
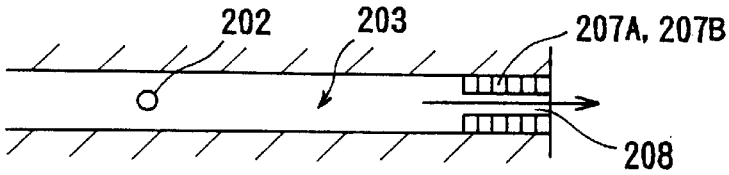

FIG. 14C shows a modification of the sloping barriers 207A, 207B, which have a discharge passage 208 defined centrally therein. The discharge passage 208 is slotted partly in the sloping barriers 207A, 207B to promote the discharge of the debris from the groove 203. The width of the discharge passage 208 needs to be selected depending on the width of the groove 203 and the amount of water to be supplied to the groove 203. It is necessary that the liquid which has overflowed the groove be supplied in a sufficient amount to the polishing surface and the debris be discharged efficiently out of the groove. For example, the width of the discharge passage 208 should preferably be at most two-thirds of the width of the groove 203. The barriers 207A, 207B may be produced by machining the bonded-abrasive element when the grooves are formed therein, or placing separate members shaped like the barriers 207A, 207B in grooves which have been formed through the bonded-abrasive. The separate members shaped like the barriers 207A, 207B may be made of a material which is the same as the bonded-abrasive, or a soft material that can easily be worn.

Figure 15A:
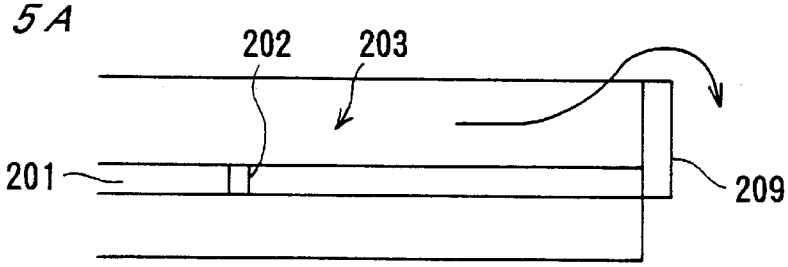
FIGS. 15A and 15B are views showing an automatically vertically movable barrier according to a modification, FIG. 15A being a cross-sectional view of the automatically vertically movable barrier when it is in use, and FIG. 15B a cross-sectional view of the automatically vertically movable barrier when it is not in use.
Figure 15B:
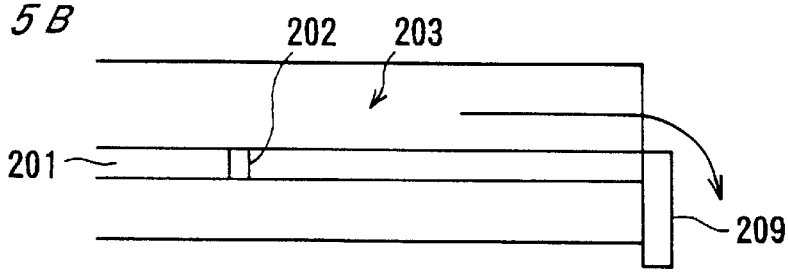

FIGS. 15A and 15B show an automatically vertically movable barrier 209 associated with the groove 203 according to a modification of the present invention. The groove 203 is supplied with liquid flowing through the liquid supply hole 202, as is the case with the embodiments shown in FIGS. 14A through 14C. According to the modification, the automatically vertically movable barrier 209 is employed in place of the sloping barriers at each of the opposite ends of the groove 203. The automatically vertically movable barrier 209 is actuated by a pneumatic actuator that can be turned on and off by a switch. When the automatically vertically movable barrier 209 is in use, it is lifted to block the groove 203. When the automatically vertically movable barrier 209 is not in use, it is lowered to discharge debris from the groove 203. The automatically vertically movable barrier 209 is preferably made of a soft material such as sponge so that it can easily be worn when the bonded-abrasive is dressed and the wafer is polished. The automatically vertically movable barrier 209 allows the liquid to be reliably stored in the groove 203 and reliably overflow the groove 203 so as to be supplied to the polishing surface when the wafer is polished, and also allows the debris to be reliably discharged from the groove 203.

The polishing apparatus with any of the above mechanisms for discharging debris may be combined with a conventional CMP apparatus comprising a polishing cloth. Before and after a substrate is polished by the polishing apparatus with any of the above mechanisms, the substrate may be polished by the conventional CMP apparatus.

According to the above various embodiments of the present invention, since debris can effectively be removed and discharged from the surface of the bonded-abrasive element and the surface to be polished of the substrate, any scratches (flaws) are effectively prevented from being made on the surface being polished.

Industrial Applicability

The present invention relates to a polishing apparatus for polishing a workpiece such as semiconductor wafers, various hard disks, glass substrates, liquid crystal panels, etc. The present invention can be used in various industrial fields such as the field of fabrication of semiconductor devices.

What is claimed is:

1. A polishing apparatus comprising:

a polishing component having a polishing surface for contacting a surface of a substrate to be polished such that the surface of the substrate is polished as the surface of the substrate and said polishing surface of said polishing component move relative to each other, said polishing surface of said polishing component having grooves defined therein for receiving debris, each of said grooves having barriers at opposite ends thereof; and a fluid ejecting component for ejecting one of a liquid and a gas into and through said grooves in said polishing surface so as to discharge the debris out of said grooves.

2. The polishing apparatus of claim 1, wherein said polishing component is operable to move relative to the substrate to be polished such that the surface of the substrate and said polishing surface of said polishing component move relative to each other with a scrolling motion having a scrolling diameter, said grooves of said polishing surface being spaced apart at a pitch equal to or less than said scrolling diameter.

3. A polishing apparatus for polishing a workpiece, comprising:

a bonded-abrasive element including abrasive particles and a binder material binding said abrasive particles;

a dressing component for dressing said bonded-abrasive element; and a fluid ejection nozzle for ejecting fluid onto a surface of said bonded-abrasive element so as to discharge debris from said surface of said bonded-abrasive element, wherein said bonded-abrasive element, said dressing component, and said fluid ejection nozzle are arranged such that the polishing of the workpiece and dressing of said bonded-abrasive element are performed simultaneously;

wherein said bonded-abrasive element is operable to rotate, and said fluid ejection nozzle is arranged downstream of said dressing component with respect to the rotation of said bonded-abrasive element.

4. The polishing apparatus of claim 3, wherein said bonded-abrasive element is disk-shaped, said fluid ejection nozzle being arranged so as to eject fluid in a radially outward direction with respect to said disk-shaped bonded-abrasive element.

5. A polishing apparatus for polishing a workpiece, comprising:

a bonded-abrasive element including abrasive particles and a binder material binding said abrasive particles, said bonded-abrasive element being operable to rotate;

a dressing component for dressing said bonded-abrasive element; and a fluid ejection nozzle for ejecting fluid onto a surface of said bonded-abrasive element so as to discharge debris from said surface of said bonded-abrasive element, wherein said bonded-abrasive element, said dressing component, and said fluid ejection nozzle are arranged such that the polishing of the workpiece and dressing of said bonded-abrasive element are performed simultaneously; and a trapping jig arranged downstream of said dressing component with respect to the rotation of said bonded-abrasive element, said trapping jig being operable to trap the debris on said surface of said bonded-abrasive element.

6. The polishing apparatus of claim 5, wherein said bonded-abrasive element is disk-shaped, said fluid ejection nozzle being arranged between said dressing component and said trapping jig and at an inner-most end of said trapping jig with respect to said bonded-abrasive element, said fluid ejection nozzle being operable to eject fluid in a radially outward direction with respect to said disk-shaped bonded-abrasive element.

7. A polishing apparatus for polishing a workpiece, comprising:

a base;

a bonded-abrasive element including abrasive particles and a binder binding said abrasive particles, said bonded-abrasive element being bonded by an adhesive layer to said base such that a polishing surface of said bonded-abrasive element faces away from said base; and a plurality of grooves cut through said bonded-abrasive element and said adhesive layer such that a depth of each of said grooves extends from said polishing surface to a surface of said base; and a fluid ejection nozzle arranged in each of said grooves so as to eject a fluid through each of said grooves for removing debris therefrom.

8. The polishing apparatus of claim 7, wherein said grooves are arranged so as to be parallel to each other.

9. The polishing apparatus of claim 7, wherein said grooves are arranged so as to form one of a grid pattern, a lozenge pattern, and a radial pattern in said bonded abrasive element and said adhesive layer.

10. The polishing apparatus of claim 7, wherein said grooves are spaced apart at a pitch in a range of 20 mm to 100 mm.

11. A polishing apparatus comprising:

a polishing component having a bonded-abrasive surface for contacting a surface of a substrate to be polished such that the surface of the substrate is polished as the surface of the substrate and said bonded-abrasive surface of said polishing component move relative to each other, said bonded-abrasive surface being operable to rotate;

a debris trapping device operable to press against said bonded-abrasive surface during polishing of the substrate so as to trap debris on said bonded-abrasive surface; and a debris discharging device for discharging the debris trapped by said debris trapping device on said bonded-abrasive surface, said debris trapping device comprising a trapping jig arranged downstream of said fluid device with respect to a rotation of said bonded-abrasive surface.

12. The polishing apparatus of claim 11, wherein said debris discharging device comprises a fluid applying component for applying one of a liquid and a gas against said bonded-abrasive surface.

13. The polishing apparatus of claim 11, wherein said debris discharging device comprises a fluid device having a plurality of fluid ejection nozzles for applying a fluid against said bonded-abrasive surface.

14. The polishing apparatus of claim 11, wherein said bonded-abrasive surface is disk-shaped, said debris discharging device further comprising a main fluid ejection nozzle arranged between said fluid device and said trapping jig and at an inner-most end of said trapping jig with respect to said disk-shaped bonded-abrasive surface, said main fluid ejection nozzle being operable to eject fluid in a radially outward direction with respect to said disk-shaped bonded-abrasive surface.

* * * * *

UNITED STATES PATENT AND TRADEMARK OFFICE

CERTIFICATE OF CORRECTION

PATENT NO. : 6,712,678 B1
DATED : March 30, 2004
INVENTOR(S) : Yutaka Wada et al.

It is certified that error appears in the above-identified patent and that said Letters Patent is hereby corrected as shown below:

Title page,
Item [54], Title, change "POLISHING-PRODUCT DISCHARGING DEVICE AND POLISHING DEVICE" to -- MECHANISM FOR DISCHARGING DEBRIS PRODUCED BY A POLISHING PROCESS, AND POLISHING APPARATUS --.

Signed and Sealed this

Twenty-ninth Day of June, 2004

JON W. DUDAS
*Acting Director of the United States Patent and Trademark Office*